United States Patent [19]

Bergsma et al.

[11] Patent Number: 4,711,028

[45] Date of Patent: Dec. 8, 1987

[54] DRY-SHAVING APPARATUS WITH A HOLDER FOR CIRCULAR CUTTING UNITS

[75] Inventors: Wijtse Bergsma; Klaas T. Oord, both of Drachten, Netherlands

[73] Assignee: U.S. Philips Corporation, New York, N.Y.

[21] Appl. No.: 944,299

[22] Filed: Dec. 18, 1986

[30] Foreign Application Priority Data

Jan. 24, 1986 [NL] Netherlands ..... 8600154

[51] Int. Cl.[4] ..... B26B 19/14

[52] U.S. Cl. ..... 30/43.6; 30/346.51

[58] Field of Search ..... 30/34, 34.1, 34.2, 43.6, 30/43.92, 346.51

[56] References Cited

U.S. PATENT DOCUMENTS 3,081,541 3/1963 Vaes ..... 30/43.6

4,137,629 2/1979 Yamazaki ..... 30/43.5

*Primary Examiner*—Douglas D. Watts

*Attorney, Agent, or Firm*—Thomas A. Briody; William J. Streeter; Rolf E. Schneider

[57] ABSTRACT

A dry-shaving apparatus comprises a holder for a circular cutting unit which includes an external cutting member formed with hair-entry apertures, having an outwardly extending annular flange portion, and movable transversely relative to the holder, and an internal cutting member rotatably drivable relative to the external cutting member. A retaining plate is positioned inside the holder. The external cutting member is detachably secured to the retaining plate, the internal cutting member being retained between the external cutting member and the retaining plate, by means of two resilient arms engaging around the flange portion of the external cutting member and secured to the retaining plate. A spring associated with the retaining plate moves the same transversely relative to the holder.

6 Claims, 6 Drawing Figures

DRY-SHAVING APPARATUS WITH A HOLDER FOR CIRCULAR CUTTING UNITS

This invention relates to a dry-shaving apparatus comprising a housing which comprises a holder for at least one cutting unit, which cutting unit comprises an external cutting member which is formed with hair-entry apertures and is movable relative to the holder, an internal cutting member which is drivable relative to the external cutting member, and a retaining plate situated within the holder.

Such a dry-shaving apparatus is known, for example, from U.S. Pat. No. 3,992,775. When the retaining plate is removed, for example for the purpose of cleaning the external cutting member and the internal cutting member, these parts are released simultaneously. It is then not unlikely that these parts fall out of the apparatus and become lost or damaged. Moreover, in an apparatus comprising a plurality of cutting units the cutting members of different cutting units may become interchanged, which is undesirable.

It is the object of the present invention to solve these problems and to this end the invention is characterized in that the external cutting member is detachably secured to the retaining plate, the internal cutting member being retained between the external cutting member and the retaining plate and the retaining plate being mounted in the holder so as to be movable by means of at least one resilient element.

The invention will now be described in more detail with reference to the accompanying drawings, in which FIG. 1 is a front view of a dry-shaving apparatus in accordance with the invention.

Figure 1:
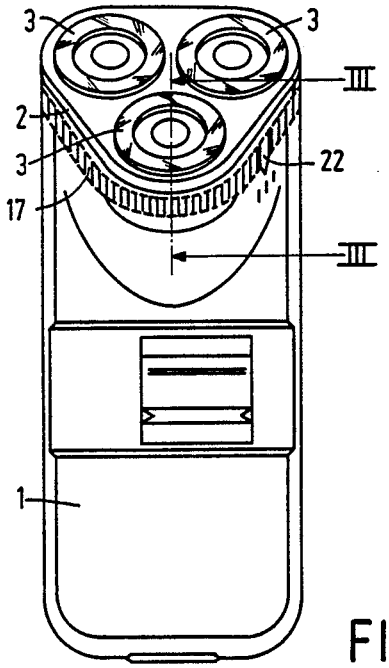
Figure 2:
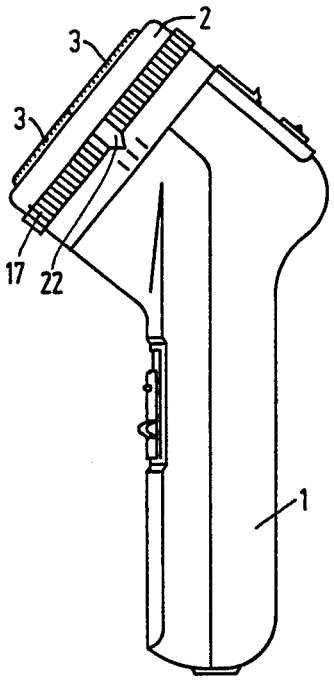
FIG. 2 is a side view of the dry-shaving apparatus shown in FIG. 1.
Figure 3:
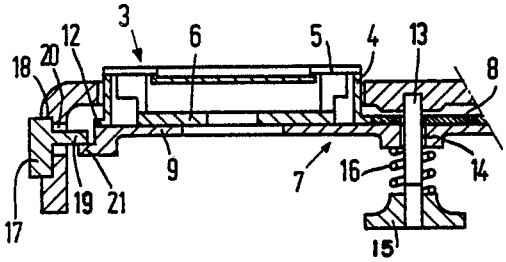
FIG. 3 is a sectional view taken on the line III—III in FIG. 1.
Figure 4:
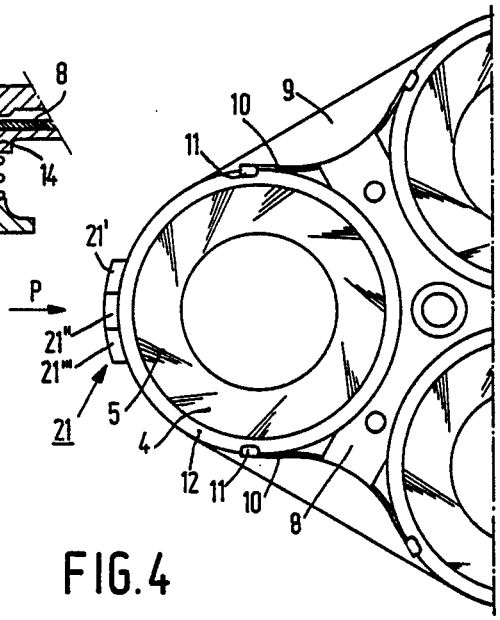
FIG. 4 is a plan view showing a part of the retaining plate used in the embodiment shown in FIG. 3.
Figure 5:
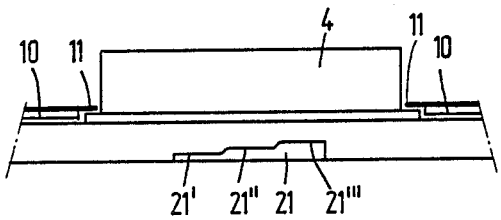
FIG. 5 is a partial side view in accordance with the arrow P in FIG. 4.

The dry-shaving apparatus comprises a housing 1 having a holder 2 for three circular cutting units 3. A cutting unit 3 comprises an external cutting member 4 formed with hair-entry apertures 5 and an internal cutting member 6 which is rotatable relative to the external cutting member. The internal cutting members can be driven by means of an electric motor which is accommodated in the housing and which is coupled to the internal cutting members in known manner. For the sake of simplicity this drive is not shown.

The external cutting members 4 are detachably secured to a retaining plate 7 arranged inside the holder 2. For this purpose the retaining plate 7 is provided with a separate common fixing element 8 which is made of metal sheet and which is secured to a plastic carrier 9. For each external cutting member 4 the fixing element has two resilient arms 10 with projections 11 on their ends. These projections 11 engage tightly around the outwardly extending annular flange portion 12 of the external cutting member 4, so that this external cutting member 4 is clamped onto the carrier 9 of the retaining plate 7. As a result of this, separate means for locking the external cutting member 4 against rotation with the internal cutting member 6 may be dispensed with. The internal cutting members 6 are retained between the exernal cutting members 4 and the carrier 9. The cutting members can be mounted on or removed from the retaining plate 7 in a simple manner by moving the external cutting members 4 in a direction parallel to the plane of the retaining plate.

The holder 2 is provided with a central pin 13 which projects through a central aperture 14 in the retaining plate 7. A fixing knob 15 is screwed onto the end portion of the central pin 13, a resilient element in the form of a helical spring 16 being compressed between the retaining plate 7 and the fixing knob 15. This enables the retaining plate 7 to be moved to a limited extent relative to the holder 2 in the axial direction of the central pin 13. As a result of this, the external cutting members secured to the retaining plate 7 are also movable relative to the holder 2 in directions substantially corresponding to the axial direction of the central pin 13. In general, the position of the retaining plate 7 in the holder 2 will be such that a part of each external cutting member 4 projects from the holder.

As a result of detachably securing the cutting unit to the retaining plate, which is movable transversely relative to the holder, the cutting unit remains also movable transversely relative to the holder. Thus, an excessive contact pressure between the cutting unit and the skin to be shaved can be avoided and if the shaving apparatus comprises a plurality of cutting units these units adapt themselves better to the curvature of the skin. An additional advantage is that when the retaining plate is removed the cutting units remain attached to the retaining plate, so that there are no loose parts which can fall out of the apparatus. The cutting units can be removed separately from the retaining plate in a simple manner, for example for the purpose of cleaning, without the risk of parts thereof being interchanged with those of another cutting unit.

The forces exerted on the cutting units by the skin during shaving are partly transmitted to the apparatus via the retaining plate 7 and the resilient element 16. As a result of this, the forces acting between an internal cutting member and an external cutting member are smaller than in the case of a construction where the external cutting member is supported only by the internal cutting member. This reduces frictional losses, so that a lower motor power may be used. Moreover, the rate of wear of the cutting members is reduced.

The extent to which the external cutting members project from the holder can be varied by means of an adjusting element which enables the position of the retaining plate 7 in the holder 2 to be varied. This adjusting element comprises an elastic annular band 17 situated in a groove 18 in the outside of the holder 2. The elastic band 17 has three inward projections 19 which extend through apertures 20 in the holder 2 and engage with the carrier 9 of the retaining plate 7. At corresponding locations the carrier 9 has three stepped portions 21 with steps 21', 21'' and 21''', the stepped portions 21 being urged against the projections 19 under the influence of the compression spring 16. If the projections 19 lie against the steps 21' the retaining plate 7 occupies a position in which the external cutting members 4 project from the holder 2 to a maximum extent. By shifting the elastic band 17 in the groove 18 the projections 19 can be made to engage with the steps 21'' or 21''', in which case the external cutting members 4 project less from the holder 2. The band 17 is provided with a pointer 22 which in each of the three relevant positions of the elastic band 17 faces a mark on the housing 1. In this way the shaving properties of the apparatus can be modified and adapted simply to personal needs.

Figure 6:
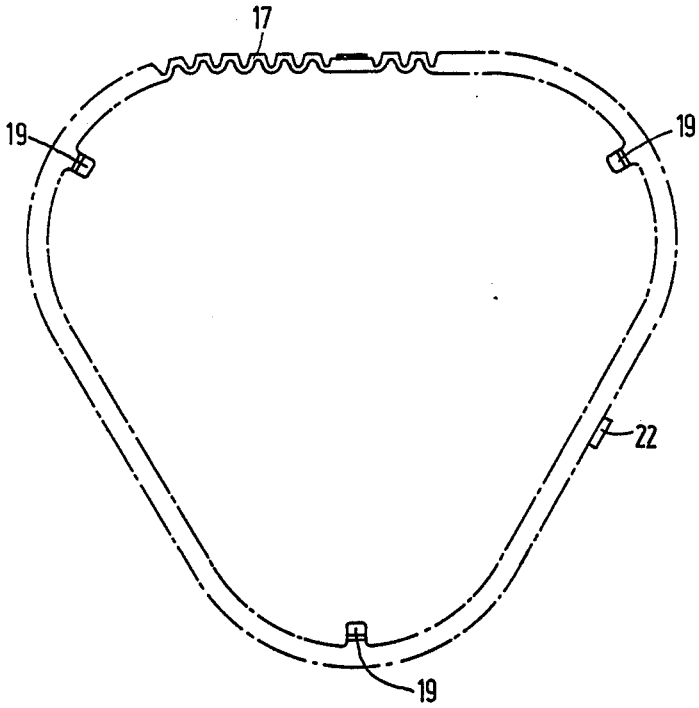
FIG. 6 is a plan view of the elastic band of the dry-shaving apparatus shown in FIGS. 1, 2 and 3.

The elastic band 17 can be mounted simply onto the apparatus and provides a large gripping area for moving the band. The band also provides a satisfactory grip if the entire holder is to be removed, in particular if the band is longitudinally corrugated as shown in FIG. 6.

Instead of a stepped wall portion the retaining plate can be provided with a wall portion having an inclined contact surface for the projections 19, enabling the position of the retaining plate relative to the holder to be varied continuously within certain limits.

What is claimed is:

1. A dry-shaving apparatus comprising a holder for a circular cutting unit; said cutting unit including an external cutting member formed with hair-entry apertures, having an outwardly extending annular flange portion, and movable transversely relative to the holder, and an internal cutting member rotatably drivable relative to the external cutting member; a retaining plate positioned inside the holder; means to detachably secure the external cutting member to the retaining plate, the internal cutting member being retained between the external cutting member and the retaining plate, said means including two resilient arms engaging around the flange portion of the external cutting member and secured to the retaining plate; and spring means associated with the retaining plate to move the same transversely relative to the holder.

2. A dry-shaving apparatus as claimed in claim 1, which includes three cutting units, and three pairs of two resilient arms respectively engaging around the flange portion of each external cutting member and forming part of a common fixing element secured to the retaining plate.

3. A dry-shaving apparatus as claimed in claim 1, in which the holder includes an adjusting element to vary the position of the retaining plate transversely relative to the holder.

4. A dry-shaving apparatus as claimed in claim 3, in which the adjusting element comprises an elastic annular band movably arranged around the outside of the holder and having a projection extending through an aperture in the holder for engagement with the retaining plate.

5. A dry-shaving apparatus as claimed in claim 4, in which the projection engages a stepped wall portion of the retaining plate, the position of the retaining plate transversely relative to the holder and hence the extent the external cutting member projects from the holder being variable by movement of the projection over the stepped wall portion.

6. A dry-shaving apparatus as claimed in claim 4, in which the elastic annular band is longitudinally corrugated.

* * * * *